United States Patent [19]

Walker, Jr.

[11] Patent Number: 4,462,498

[45] Date of Patent: Jul. 31, 1984

[54] SELF INDEXED RECORD ALBUM RACK

[76] Inventor: Fred Walker, Jr., 745 W. Colden Ave., Los Angeles, Calif. 90044

[21] Appl. No.: 281,881

[22] Filed: Jul. 9, 1981

[51] Int. Cl.[3] ..... A47F 7/00

[52] U.S. Cl. ..... 211/40; 211/55; 211/87

[58] Field of Search ..... 211/40, 87, 52, 55, 211/128, 133, 60 R, 60 T, 41, 56, 50, 86; 248/451, 499; 224/42.39; 40/124, 124.2; 312/8, 9, 13

[56] References Cited

U.S. PATENT DOCUMENTS

| | | | |
|---|---|---|---|
| 18,519 | 8/1888 | Crabtree | 211/87 X |
| 19,907 | 6/1890 | Morse | 211/87 X |
| 832,549 | 10/1906 | Landon | 40/124.2 |
| 1,276,034 | 8/1918 | Craig | 211/87 |
| 1,303,229 | 5/1919 | Hahl | 211/87 X |
| 1,731,875 | 10/1929 | Snyder | 211/52 |
| 2,141,008 | 12/1938 | Meyer | 211/187 X |
| 2,433,748 | 12/1947 | Eide | 211/187 X |
| 2,608,012 | 8/1952 | Jackson | 40/124.2 |
| 2,634,865 | 4/1953 | Geheb | 211/41 |
| 2,759,454 | 8/1956 | Swart | 40/124 X |
| 2,963,808 | 12/1960 | Guichard | 211/55 X |
| 3,486,634 | 12/1969 | Frater | 211/128 X |
| 3,810,328 | 5/1974 | Lowe | 40/124 |
| 4,102,458 | 7/1978 | Fors | 211/40 |

FOREIGN PATENT DOCUMENTS

| | | | |
|---|---|---|---|
| 616880 | 2/1961 | Italy | 40/124 |

*Primary Examiner*—J. Franklin Foss
*Assistant Examiner*—Robert W. Gibson, Jr.
*Attorney, Agent, or Firm*—Howard L. Johnson

[57] ABSTRACT

A rack for holding a quantity of record albums, each in a display position of at least partial visibility so as to be individually identifiable for selection by the user. An upstanding backing support which may be hung vertically against a wall or alternately back-tilted when floor supported, has vertically separated transverse ledges, each of which can support the lower edges of several upstanding albums (laterally overlapping). The backing support and its rows of upstanding albums is loosely overlaid lengthwise (vertically) by a restraining member such as a cord or chain which thus holds the total albums in place while allowing any individual album to be manually withdrawn and replaced laterally.

6 Claims, 7 Drawing Figures

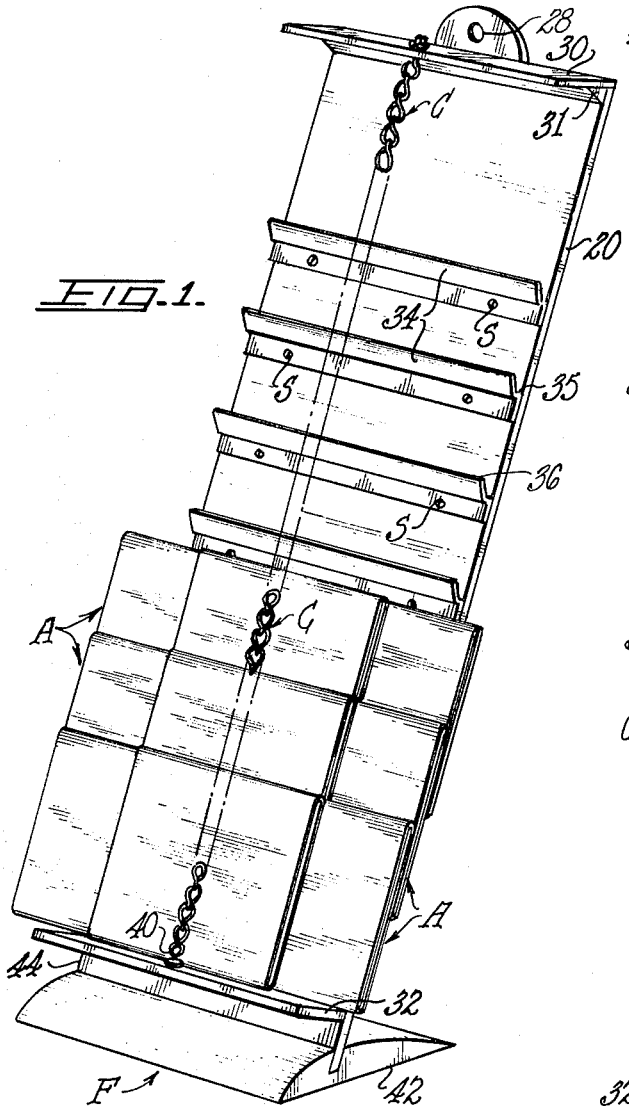
FIG. 1.
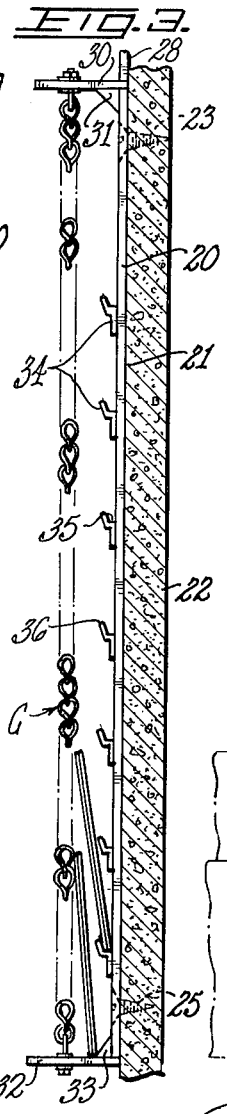
FIG. 3.
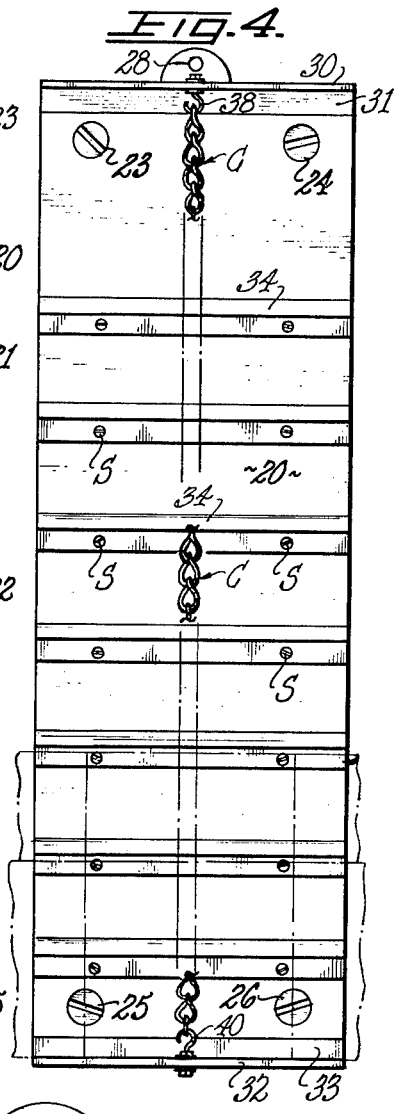
FIG. 4.
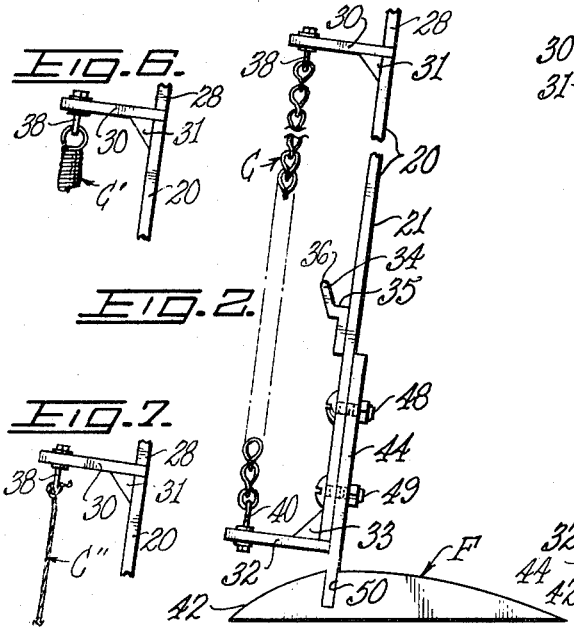
FIG. 2.
FIG. 6.
FIG. 7.
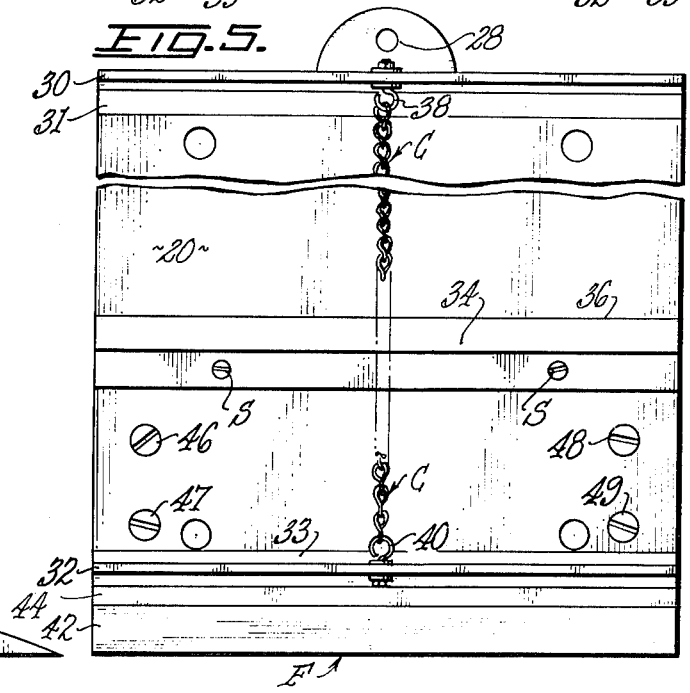
FIG. 5.

SELF INDEXED RECORD ALBUM RACK

BACKGROUND OF THE INVENTION

This invention relates to holding or exhibition racks for display/storage of a plurality of thin, usually rectangular and similar-size articles, particularly phonograph record albums. Such an album may contain a single record and the album or slip cover is usually decorated or overlaid with description and design which identifies the particular record contained therein. For the collector and frequent user of a large quantity of such records, easily accessible storage facilites are essential. However it is even more desirable to have a responsive indexing system for such collection, that is, so that one does not need theoretically to look at each successive unit of the total collection in order to locate a particular record which the collector remembers is there. Various systems of indexing and retrieval, using large storage cabinets have been worked out, but although effective, they are both complicated and expensive. In contrast, the present assembly provides a simple holding unit which leaves each record album at least partially visible, so as to require no further or systematic indexing. Such unit can be replicated any number of times and can be located in a minimum of space, such as hung upon the wall of a room, or be placed upstanding upon a floor or table as available.

SUMMARY

The invention provides a generally upstanding rack for holding a multitude of phonograph records in individual (slip) albums, each album held in at least partially visible position so as to be self-indexing by visual recognition of the cover color, design and/or some added indicia. Each album is thus individually withdrawable and replaceable without disturbing the others—by lateral sliding action along the particular support ledge. The rack consists of a generally planar backing or support member having a series of vertically separated, outward extending, transverse ledges each disposed to support the lower edge of one or more record albums which are thus positioned, upstanding and slightly outtilted from the backing surface by reason of rear-face contact with the adjacent ledge thereabove. Such rack can be hung against a vertical wall, in which case the record albums are tilted forward. Or, by use of a detachable pedestal or footing member, the rack can be placed backtilted on a table or floor, in which case the album clusters are disposed substantially vertically on each ledge. In either event, they are retained in place by a vertical, restraining member such as a cord or chain which is transversely centered to longitudinally and spacedly overlie the forward face of the support member and is terminally secured adjacent each top and bottom margin thereof, thus contacting the upper edge of at least one record album of each ledge.

BRIEF DESCRIPTION OF THE DRAWINGS

FIG. 1 is a perspective view as seen from the front, of the record album rack with its detachable pedestal or foot supporting it upstanding from a level surface or floor, and the lower ledges holding record albums.

FIG. 2 is a vertical elevation of the same, shown foreshortened and with a single ledge for better illustration.

FIG. 3 is a side elevational view of the album record holder shown attached to a vertical support or wall and with the foot attachment removed.

FIG. 4 is a front elevational view of the wall-attached assembly of FIG. 3.

FIG. 5 is a front elevational view of the floor-supported assembly of FIG. 2.

FIGS. 6 and 7 are lateral elevations wherein the restraining member takes the form of a coil spring and cord respectively.

DETAILED DESCRIPTION OF PREFERRED EMBODIMENT

An elongated, generally planar support member 20 is provided with a flat, rear face 21 which can be secured in registration with a vertical structural wall 22 (FIG. 3) as by screws 23, 24, 25, 26 and/or by a projecting wall peg (not shown) received through a tab aperture 28 of the support member. Along the upper and lower margins of the back support 20, respective upper and lower shelves 30, 32 extend forward, held by wedge-shaped transverse bracing strips 31, 33.

The forward surface of the support 20 carries a group of transverse, forward-projecting and upslanted ledges 34 vertically spaced apart so as to form a series of cross steps which are located at similar intervals up the height of the support. Individual ledges may be attached to the support by coupling elements such as screws S, the ledges being formed of the same or different material as the support 20, such as metal, wood, composition board, etc. Alternately, both the backing support and the ledges may be molded as one piece from synthetic resin ("plastic"). The cross length of a ledge (like the backing surface) is formed of such minimum length that two record albums (A) can be placed thereon edge to edge without overlapping. Hence a third album can be centered in the groove 35, lying flat against one-half of each of the first two, i.e. overlapping a half of each of the two. Accordingly the ledge has a minimum width twice that of a record album; at least a portion of the front of each of the three albums is thus visible and readily identifiable by the user by its color, design or indicia (the latter added if necessary). Thus the entire obverse face of the jacket or album need not be glimpsed to be identified.

It will be seen that the reverse faces of the rear pair of albums are held forward by line contact with the projecting edge 36 of the ledge 34 immediately above. Thus with the backing support 20 aligned with or in registration with a vertical wall 22 (FIGS. 3–4), the collective albums are disposed slanted or tilted forward. Alternately, when the assembly is self-standing in a back tilted position (FIGS. 1–2), the group of albums are disposed approximately vertical.

In order to secure the albums in their ledge located positions, while still leaving each one individually withdrawable laterally from one end or the other of a groove 36, there is provided a generally linear, restraining member C disposed longitudinally, centrally (spacedly) overlying the support member 20 and terminally secured to the upper 30 and lower 32 shelves by respective anchorage units 38, 40. With a trio of albums A bottom-edge supported on a ledge as just described, the central album will be loosely or frictionally (as the case may be) overlaid by the restraining member C so as to hold all three in place. The restraining member C may consist of a small spiral spring as here illustrated (FIG. 6), which in some instances may be incased in a sheath or cable wrapping. Or the restraining member may be formed of natural or synthetic strands of material, twisted or intertwined to form a rope or cord (FIG. 7). In some instances, the longitudinal length of C may simply be supplied by a metallic wire of sufficient strength or thickness. However the chain C (FIGS. 1-5) is particularly satisfactory.

In order to position the assembly upright or self-standing upon a horizontal floor or surface, there is provided a detachable footing member F (FIGS. 1-2) consisting of a transverse, flat-bottom pedestal 42 having a fixed angularly upstanding panel 44 which by quick-coupling means, such as the two pairs of threaded bolts 46, 47, 48, 49, is secured in juxtaposition with the lower rear margin of the support member 20. Alternately, the panel 44 may remain fixed to the support 20 with its dependent margin 45 thrust-insertable into the pedestal socket 50.

I claim:

1. A record album rack adapted for functional location in alternate vertical and backtilted positions when holding a plurality of individually withdrawable, upstanding, generally rectangular, laterally overlapping, edge-supported record albums arranged in cross rows formed by forward projecting, transverse ledges and thus disposed against a forward surface of the rack, each album having substantially planar obverse and reverse faces, said rack comprising an upstanding, elongated, generally planar, support member having a forward surface with a vertical series of transversely directed, forward extending ledges individually adapted for lower-edge support of a plurality of generally rectangular record albums upstanding in a semi-display position thereupon wherein the reverse face of each record album is disposed closely adjacent and slightly outtilted from said support member by reason of line contact with the proximate ledge thereabove, said ledges having a minimum width equal to twice the thickness of a record album, a central one of a row of said record albums along a ledge being disposed partially overlying a laterally adjacent album of a row and each record album of a ledge-supported row being selectively removable by endwise withdrawal from the respective ledge, and a generally linear, restraining member fixedly terminally secured adjacent upper and lower margins of the support member and disposed generally vertically, spacedly overlying the forward surfac of the support member and thus positioned to restrainingly contact an upper edge portion of the obverse face of a central record album of each ledge, thereby retaining the collective record albums of each ledge from undesired forward displacement from the rack.

2. A record album rack according to claim 1 wherein said restraining member comprises a chain.

3. A record album rack according to claim 1 wherein said restraining member comprises a coil spring.

4. A record album rack according to claim 1 wherein said restraining member comprises a cord.

5. A record album rack according to claim 1 wherein said support member includes attachable foot support means adapted to maintain said rack free-standing in backslanted position as upon a floor or table.

6. A record album rack according to claim 5 which includes means for hanging the same against a generally vertical structural wall, in planar registration therewith.

* * * * *